United States Patent [19]

Komori et al.

[11] Patent Number: 4,662,740

[45] Date of Patent: May 5, 1987

[54] ELECTROPHOTOGRAPHIC DEVICE

[75] Inventors: Shigehiro Komori; Hisashi Sakamaki, both of Yokohama; Hiroyuki Hattori, Mitaka; Toshihide Iida; Koichi Miyamoto, both of Tokyo; Kazumi Umezawa, Yokohama, all of Japan

[73] Assignee: Canon Kabushiki Kaisha, Tokyo, Japan

[21] Appl. No.: 705,046

[22] Filed: Feb. 25, 1985

Related U.S. Application Data

[60] Continuation of Ser. No. 338,048, Jan. 8, 1982, abandoned, which is a division of Ser. No. 034,023, Apr. 27, 1979, Pat. No. 4,330,199, which is a division of Ser. No. 778,180, Mar. 16, 1977, Pat. No. 4,185,909, which is a continuation of Ser. No. 600,860, Jul. 31, 1975, Pat. No. 4,017,170, which is a continuation of Ser. No. 348,092, Apr. 5, 1973, abandoned.

[30] Foreign Application Priority Data

| | | | |
|---|---|---|---|
| Apr. 13, 1972 | [JP] | Japan | 47-37288 |
| Apr. 15, 1972 | [JP] | Japan | 47-38149 |
| Jun. 20, 1972 | [JP] | Japan | 47-72961[U] |

[51] Int. Cl.[4] ..... G03G 15/00; G03G 21/00

[52] U.S. Cl. ..... 355/3 SH; 355/14 SH

[58] Field of Search ..... 355/3 R, 3 SH, 14 R, 355/14 SH

[56] References Cited

U.S. PATENT DOCUMENTS

| | | | |
|---|---|---|---|
| 3,588,472 | 6/1971 | Glaster et al. | 355/14 X |
| 3,589,808 | 6/1971 | Del Vecchio | 355/3 R |
| 3,693,969 | 9/1972 | Sakamaki et al. | 355/14 X |
| 3,948,586 | 4/1976 | Komori et al. | 355/14 R |
| 4,017,175 | 4/1977 | Washio et al. | 355/14 SH |

*Primary Examiner*—Fred L. Braun

*Attorney, Agent, or Firm*—Fitzpatrick, Cella, Harper & Scinto

[57] ABSTRACT

A copying apparatus has a device for transporting copy material along a path, a device for detecting copy material along the path, first and second modes in which first and second timing signals are produced, respectively, and a jam detector, responsive to the absence of a detection by the detection device prior to the first or second timing signal, for producing an output.

4 Claims, 20 Drawing Figures

*CONVERTED INTO DRUM POSITION.

ELECTROPHOTOGRAPHIC DEVICE

This application is a continuation of Ser. No. 338,048, filed Jan. 8, 1982, now abandoned, which is a division of Ser. No. 34,023, filed Apr. 27, 1979, now U.S. Pat. No. 4,330,199 issued May 18, 1982, which in turn is a division of Ser. No. 778,180, filed Mar. 16, 1977, now U.S. Pat. No. 4,185,909 Issued Jan. 29, 1980, which in turn is a continuation of Ser. No. 600,860, filed July 31, 1975, now U.S. Pat. No. 4,017,170 issued Apr. 12, 1977, which in turn is a continuation of original application Ser. No. 348,092 filed Apr. 5, 1973, now abandoned.

BACKGROUND OF THE INVENTION

1. Field of the Invention:

The present invention relates to improvements in electrophotographic devices in general, and more particularly to improvements in electrophotographic devices which can obtain images of good quality by making the potential at the surface of the photosensitive body substantially uniform at the termination of copying, by adjusting optical systems, by making uniform exposures, and the like.

2. Description of the Prior Art:

Of two typical types of electrophotography, one type uses a photosensitive paper and the other type uses a conventional paper onto which is transferred an image which has been formed on a photosensitve layer consisting mainly of CdS, Zinc oxide and the like.

This invention relates to the latter type. A photosensitive member having a photoconductive layer consisting of CdS, Zinc oxide, Se, etc. and a conductive base of Al, etc. is disposed around the periphery of a rotatable drum. This drum type photosensitive member, similar to a belt type photosensitive member, is disposed at the center portion of the electrophotographic device and disposed around this photosensitive member are a positive or negative corona charger for uniformly charging said photoconductive layer (either positive or negative as determined according, for example, to the P type or N type nature of the photoconductive layer), an optical system a, corona discharger (positive or negative) for separating a transfer paper from the drum or a corona charger for improving the transfer of the image are disposed.

To such a device as mentioned above, when all processes necessary for copying are repeated for obtaining the necessary numbers of copies, the rotation of the drums is stopped simultaneously with the cutting off of the power source for the chargers, a uniform influence is not effected by the corona charger with the provision of said chargers in a spaced relation in the periphery of the drum. As a result, charged and uncharged portions are produced and if permitted to remain, the photoconductive layer is differently affected. Therefore, at the time of successive copying, a charge is not imparted uniformly to the photoconductive layer which often produce an uneven image and thus one is not able to obtain an image of the best quality.

The invention eliminates the aforementioned disadvantages. An uneven or dim image is sometimes caused by a slight error in length of the light path of an optical system (from the original to be exposed to a photosensitive body) between a device in design and an actual device. Further, it is difficult to uniformly illuminate the original so that there is sometimes produced a difference of exposure between the central part and the peripheral part of the light image.

The present invention eliminates the disadvantages noted above.

An object of this invention is to provide jam detection in a copying apparatus which is operative in a plurality of copy modes.

The invention comprises means for transporting a copy material along a transport path, means, located in the path, for detecting the presence of copy material, means for presetting a first or a second copy mode, means for producing first and second timing signals in accordance with the set mode and jam detecting means responsive to the detecting means for detecting jamming when the detecting means does not detect copy material prior to the occurrence of the timing signal for the set mode. The copy modes may relate to the copy size or the original scanning method. Where the copying apparatus includes a rotatable photosensitive medium, the timing signals may be based on the rotation of the rotatable medium.

DESCRIPTION OF THE PREFERRED EMBODIMENT

An embodiment of the invention will now be described referring to a particular copying machine.

In this embodiment, a photosensitive body comprises a three-layer construction having a surface insulating layer, a conductive base material, and a photoconductive layer inserted between said two members, and as a process, first, D.C. corona discharge is applied to the photosensitive body by a primary charge means to be charged positive. Then, A.C. corona discharge is applied to the photosensitive body and at the same time a light image of the original to be copied is exposed. Further, the photosensitive body is totally exposed to thereby elevate the contrast of the electrostatic latent image and a visible image is formed by toner development having a polarity opposite to that of the electrostatic latent image. Although the foregoing process will be described below, it is not our intention to limit the invention to the aforesaid process, which is merely employed for the purpose of facilitating description.

Figure 1:
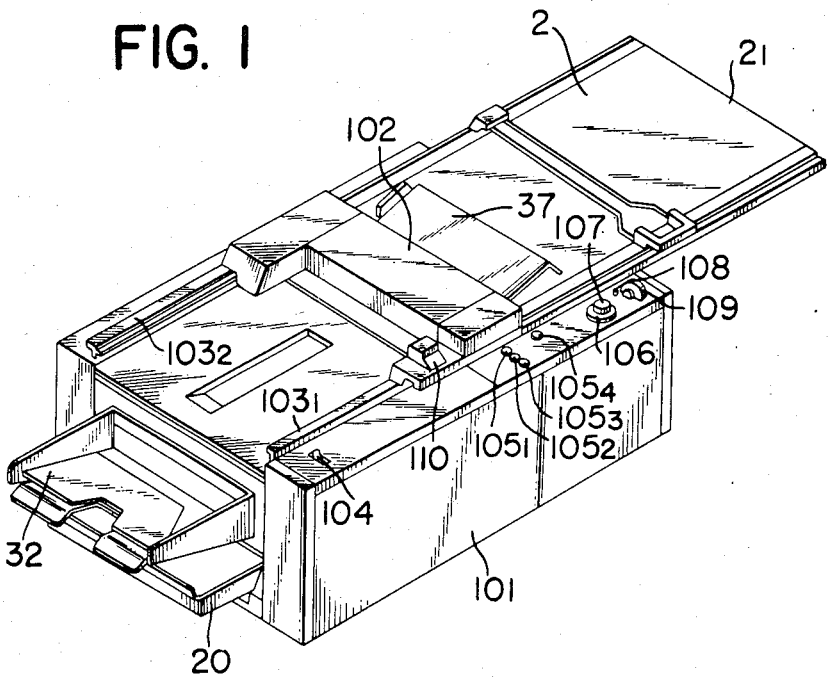
FIG. 1 is a perspective view showing the exterior of a copying machine according to this invention.
Figure 2:
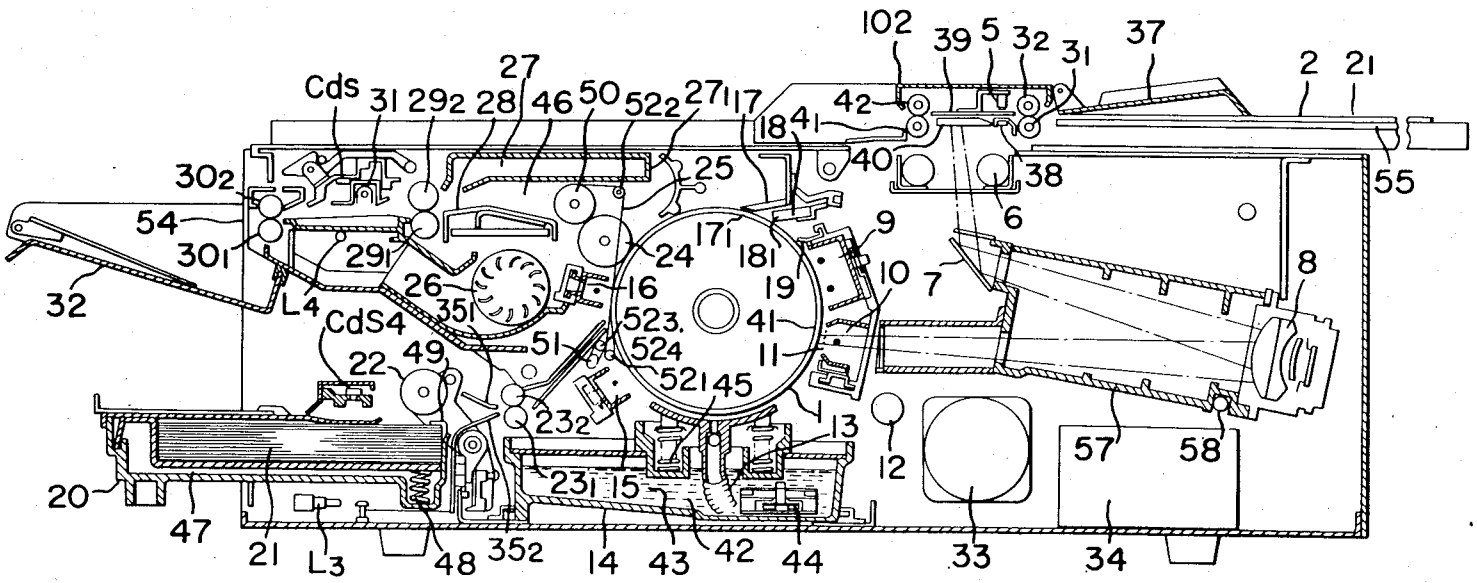
FIG. 2 is a front view longitudinally sectioned of the machine of FIG. 1.

To being with, the mechanical operation is principally schematically described and the operation of the electrical system follows. FIG. 1 shows the exterior of a copying machine and FIG. 2 is a longitudinally sectioned view thereof.

This copying machine is a liquid development transfer type adapted to easily copy principally originals such as sheet-like papers, and also thick originals such as books, when necessary.

Referring now to FIG. 1, there is provided a machine case denoted 101, a sheet original feed part at 102, and an original base 2 on which a thick original (hereinafter called "book original") may be placed, an original holder cover $2_1$ being placed on said base. There are shown guide rails $103_1$, $103_2$ for the original base, cassette 20 for housing a transfer paper 21, a tray 32 to receive transfer paper ejected from the machine after transfer, a main switch 104, a group of alarm lamps $105_1$, $105_2$, $105_3$, and $105_4$, a knob 106 for selecting the number of papers to be continuously copied from the book original, a copy button 107 which serves also for a re-start (hereinafter described) located in the central portion, a stop button 108 for releasing the continuous copying of the book original, and a dial 109 for controlling copying concentration interlocked with the diaphragm of a lens.

The operation of this copying machine will be described referring to FIG. 2 first in consideration of sheet originals. After the lapse of start preparation time, when a sheet original is inserted from the sheet original guide 37 into sheet original feed first rollers $3_1$ and $3_2$ at the sheet original feed part 102 which rotates in synchronisation with a constantly rotating drum 1, said original is transported leftwards as viewed in FIG. 2. When the extreme end of said original is detected by a sheet original timing lamp 5 and a light receiving element 38, the sheet original feed first rollers stop and the original also stops with the stoppage thereof. Then, when the drum reaches a desired position as required and an original start signal is transmitted, the sheet original feed first rollers $3_1$ and $3_2$ begin to rotate again and the original is transported leftwards in synchronisation with the drum 1 and is ejected outside the machine by sheet original feed second rollers $4_1$ and $4_2$. During that time, the original passes above an original glass 40 and is exposed to light radiation from the bottom by two illuminating lamps 6. An image of said original is formed on the drum 1 at the exposure part 41 by the reflection mirror 7 and in-mirror lens 8.

The drum 1, which has a photosensitive layer covered with a transparent insulation layer, always rotates in a clockwise direction as shown in FIG. 2. The drum 1 is first charged positive by a positive charger 9 which is supplied with a positive high current from a high voltage source 34. When the drum then reaches exposure part 41, an image from the illumination part 39 is slit exposed and simultaneously an AC charge is supplied thereto by an AC charger 10 which is supplied wth an AC high voltage current from the high voltage source 34. By means of a general exposure through the general exposure lamp 12 an electrostatic latent image is formed on the surface of the drum which then enters a developing machine 42.

The developing machine 42 comprises a tank 14 for developing solution 43, a pump 44 for stirring and pumping developing solution, and a developing electrode 13, said electrode 13 always being pressed against the drum 1 by means of a spring 45 maintaining a fine clearance therebetween. The electrostatic latent image formed on the drum 1 is developed and image-formed by toner in developing solution 43 pumped on the developing electrode 13. Then, a charge developed by a negative high current from the high voltage source 34 at a minus charger 15 presses out excessive developing solution on the drum 1 without disturbing the image. Then, transfer paper 21 transported from the paper feed part is adhered closely to the drum 1 and the image on the drum 1 is transferred to the transfer paper 21 by the charge developed by a positive high current from the high voltage source 34 at the transfer charger 16.

The transfer paper 21 already transferred with image is separated from the drum 1 by means of a separation belt 25 and is introduced into a drying-and-fixing part 46. The remaining toner and developing solution are wiped away from the drum 1 by edges $17_1$ and $18_1$ of skirt 17 and blade 18, respectively, and the drum repeats its rotation for successive cycles. The developing solution wiped away by means of cleaners 17 and 18 is introduced into the developing machine 42 through a peripheral groove $1_1$ made in both ends of the drum 1 and may be used again in another development. A toner receiving member 19 is provided which is adhered closely to the drum 1 to prevent toner which is solidified in the rear of the blade 18 from adhering to the drum and dropping off.

On the other hand, the transfer paper 21 is housed in the cassette 20 and is detachably provided in the paper feed part located at the lower part on the left hand of the machine. Various kinds of cassettes may be employed according to the sizes of several kinds of transfer paper and may be replaced easily whenever necessary. The transfer paper 21 is placed on the middle plate 47 within the cassette 20 and urged upwardly toward the uppermost portion of the cassette 20 by the action of spring 48. In this case, the spring constant of said spring 48 is suitably selected so as to maintain the force by which the uppermost transfer paper is pushed up constant irrespective of the number of transfer papers 21 within the cassette 20.

When the drum 1 reaches a predetermined position, a signal is produced to move down the usually rotating paper feed roller 22 which in turn contacts the uppermost sheet of transfer paper in the cassette 20, and presses down a given amount of the transfer paper. Simultaneously, a separation pawl 49 mounted on both sides of the extreme end of the cassette 20 and resting on the uppermost transfer paper moves down by virtue of its own weight. A piece of transfer paper 21 is separated by rotation of the paper feed roller 22 and by the action of the separation pawl 49 and is transported in the right direction as shown in FIG. 2. However, timing rollers $23_1$ and $23_2$ located nearby will stop immediately after the paper feed roller 22 has been moved down so that the transfer paper 21 sent out of the cassette 20 is stationary between paper guides $35_1$ and $35_2$ whereby the extreme end of the paper abuts the nip formed by timing rollers $23_1$ and $23_2$. Immediately after that, the drum 1 transmits a signal to start feeding paper and the timing rollers $23_1$ and $23_2$ begin to rotate to feed the transfer paper 21 at a speed in line with the surface speed of the drum 1. On the other hand, after the lapse of a given time, the paper feed roller 22 moves upwards again separating from the transfer paper 21, and thereafter paper feeding is carried out by a paper feed means provided after the timing rollers $23_1$ and $23_2$.

As previously mentioned, the already transferred transfer paper 21 adhered closely to the drum 1 is separated from the drum 1 by means of the separation belt 25. The separation belt 25 is a narrow endless belt and is connected to the separation roller 24, turning pulleys 50, 51 and pulley $52_1$, $52_2$, $52_3$, and $52_4$, arranged in a slight spaced relation with the drum 1. The belt between the pulley $52_1$ and the separation roller 24 is rested on the drum 1 in a position corresponding to the end of the side of the transfer paper, and the belt between the pulley $52_2$ and $52_3$ passes the position determined by the direction in which the transfer paper passes by action of turning pulleys 50 and 51. The separation belt 25 is driven by the separation roller 24 at the same speed as that of drum 1. At the time when the transfer paper 21 is adhered closely to the drum 1 in the transfer process, the end of one side thereof pinches the separation belt 25 therebetween. As a result, when the separation belt 25 is separated from the drum 1 by means of the separation roller 24, the one side of transfer paper 21 adhered closely to the drum is forcibly separated from the drum. The transfer paper 21 (having one end thereof separated) is completely separated from the drum 1 due to its own stiffness and because of the air blown-out from blower not shown through outlet $27_1$ of duct 27, and the negative pressure produced by a suction blower 26, and is sent into the drying-and-fixing part 46.

In the drying-and-fixing part 46, the transfer paper 21 moves forward having its back side adhered closely to the hot plate 28 which encases a heater therein and is dried and fixed by conduction heat from the hot plate. The dried and fixed transfer paper 21 passes through first ejection rollers $29_1$ and $29_2$, and after any remaining charge on the surface of the paper has been removed by a discharger 31, the transfer paper is introduced to an outlet 54 by second ejection rollers $30_1$ and $30_2$ and is ejected onto the tray 32.

Operation employing book original will now be described. The condition of the sheet original is changed into the condition of the book original by turning the change-over knob 110 at the extreme end of the original base and then suitably moving the original base leftwards as shown in FIG. 2. In this way, by moving the original base 2 from the sheet original position to the book original position, supply of a drive current to the sheet original feed part 102 is disconnected so that all the circuits may be changed-over for use of the book original.

The book original to be copied is put on the original base glass 55 adjusting the extreme end of the original to the extreme end $55_1$ of the glass and held by the holder cover $2_1$, and when a copy button 107 is depressed, the original base 2 is moved leftwards as shown in FIG. 2 by an original start signal in synchronization with the peripheral speed of the drum 1, in a manner similar to that of a sheet original, for slit exposure. In the midst of travel, the original base 2 produces a paper feed start signal for initiation of paper feed in synchronization with the exposure. At the termination of exposure, the original base 2 stops its leftward movement, detecting its position, and immediately returns in a reverse direction, that is, rightwards. This return speed is faster than the reciprocating speed so that the efficiency of copying may be promoted. When the original base is returned to the initial position for the book original, the original base 2 stops.

If a large number of copies of the book original are desired, this can easily be carried out by means of a counter 106 interlocked with the copy button 107. This counter 106 performs a count by detecting the movement of the original base and keeps the copy button 107 depressed until the desired number of is produced copies.

Other than the above-described difference the operation is the same as in the case with the sheet original.

In this copying machine, the drum 1 is so designed that sheets of a length of up to A3 and a standard width may be copied, and the length of the outer periphery of the drum is slightly longer than the length of A3. Therefore, in the case of a sheet original whose length is A3, one sheet can be copied per one rotation of the drum 1, and if an original of A4 is fed in a lengthwise direction and in a direction at right angles, two sheets can be copied per one rotation of the drum 1. On the other hand, in the case of a book original, it requires almost the same time for backward movement as that of a forward movement followed by the forward movement (exposure process) of the original base 2 so that the time required for copying one piece takes approximately twice that of a sheet original. That is, in the case of A3 original, one can be copied per two rotations of the drum and one A4 original can be copied per one rotation of the drum.

The difference of cycle due to the size of paper, as described above, is discriminated by a signal from the cassette 20 while the difference of cycle due to the kind of original (book or sheet) is discriminated by a signal obtained by changing the position of the original base.

The preparation operations prior to a general copying operation, the suspension thereof after the termination of operation, and re-start will now be described. As described above, this copying machine is of the liquid development type in which toner in the developing solution is fixed by vaporization of the carrier liquid. Further, since the toner or developing solution remaining on the drum 1 after transferred is cleaned by cleaners 17 and 18, a fine amount of toner is always accumulated in the vicinity of edges $17_1$ and $18_1$ of each cleaner. If the machine is stopped and left as it is such a condition as mentioned above, the carrier in edges $17_1$ and $18_1$ vaporize and the toner solidifies. If the drum 1 is rotated again in that condition, the edges $17_1$ and $18_1$ of the cleaners and the surface of the drum 1 are damaged or the resulting image is poor. In this copying machine, therefore, even if the main switch 104 is turned on, the drum 1 is not immediately rotated but only the pump 44 for the developing machine 42 runs, and at the same time when the developing solution is stirred, the developing solution 43 is pushed up to reach the liquid feed pipe 56, thus pouring into the cleaner 18. After the lapse of a given time, the toner in the edges $17_1$ and $18_1$ softens and then the drum 1 begins to rotate to wipe off said softened toner, and after the drum has rotated at least by half revolution, the sheet original feed rollers $3_1$ and $3_2$ in the sheet original feed part 102 begin to rotate to commence the copying operation.

On the other hand, if the power source is left in its ON condition after the whole copying operation has been completed, the drum 1 are cleaners 17 and 18 and adversely affected in their durability by the continuous rotation of the drum 1. This copying machine is, therefore, so designed that in the event the successive copying operation is not performed after the lapse of a given time upon completion of a certain copying operation, the drum 1 is automatically stopped even if the main switch 104 is in the ON position. This period of time is set longer than the time required for driving the most recently copied transfer paper 21 outside of the machine and cleaning the whole surface of the drum 1.

The drum 1 is stopped in position such that a seam portion of the photosensitive layer, that is, a part where no image is formed, comes to the edge $18_1$ of the cleaner 18 to prevent an influence on the image by the solidified toner. Further, prior to the stoppage of the drum 1, all the charges other than the AC charge are deenergized so that the drum may be stopped and the AC-charged photosensitive surface discharges uniformly. The reason for this is as follows: In use, the drum 1 has its respective portions energized with different charges by charging through respective chargers. As a result, when the drum enters the stopped or suspended condition and at the same time the respective charges are denergized, the respective portions of the drum 1 are therefore charged different. The maintenance of such a charge condition changes the characteristics of the photosensitive layer. For example, a portion charged negatively by the negative charger 15 may not sufficiently be charged positively by the positive charger during the next successive copying cycle, and only said portion is formed with an image having a low concentration, thus producing a poor image. This causes the life of the photosensitive layer to be shortened. In order to avoid this, the present copying machine is so designed that the drum 1 is stopped after the whole surface of the drum has been uniformly discharged.

Further, at the time of the stopped condition, if the copy button 107 (serving also as a re-start button) is depressed, the machine is restored to the condition existing prior to the stoppage.

Figure 5:
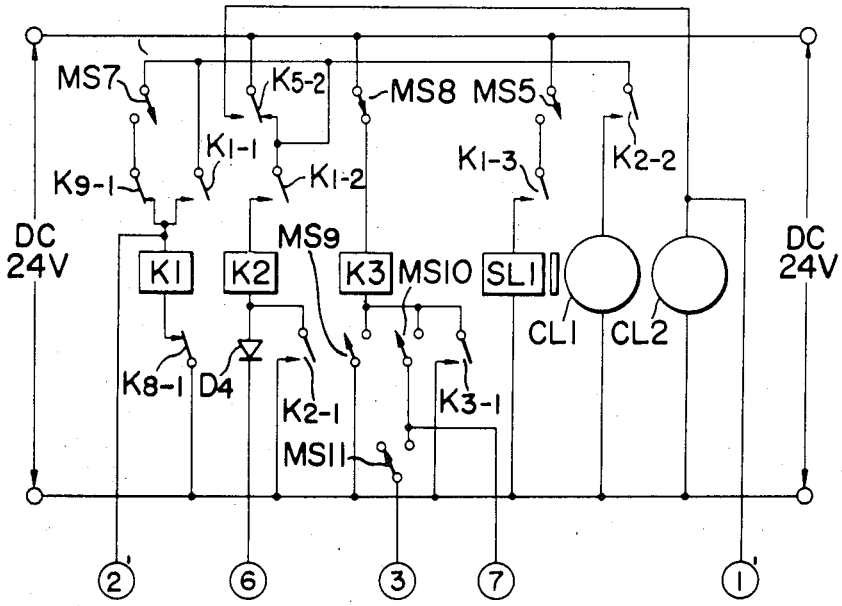
FIG. 5 is a diagram showing the electric circuit for driving and controlling an original base.
Figure 9:
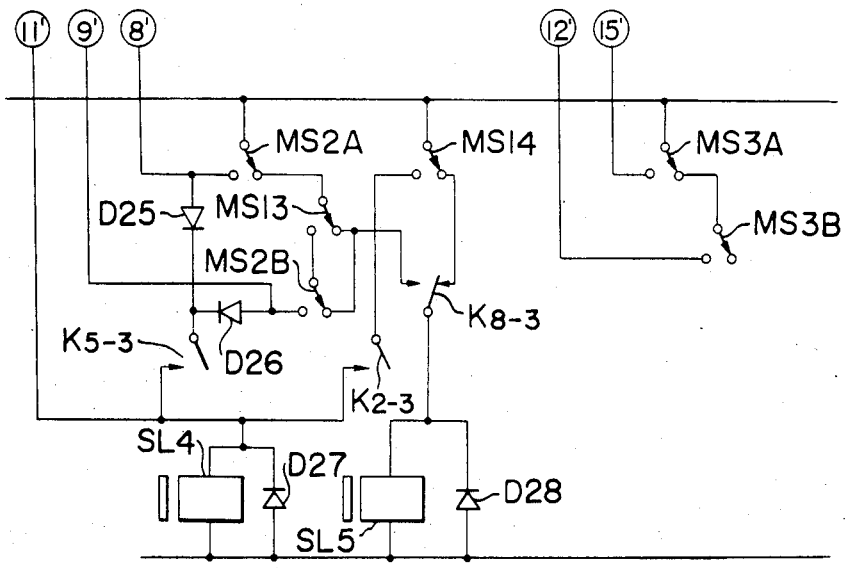
FIG. 9 is a timing circuit for feed paper jam.
Figure 10:
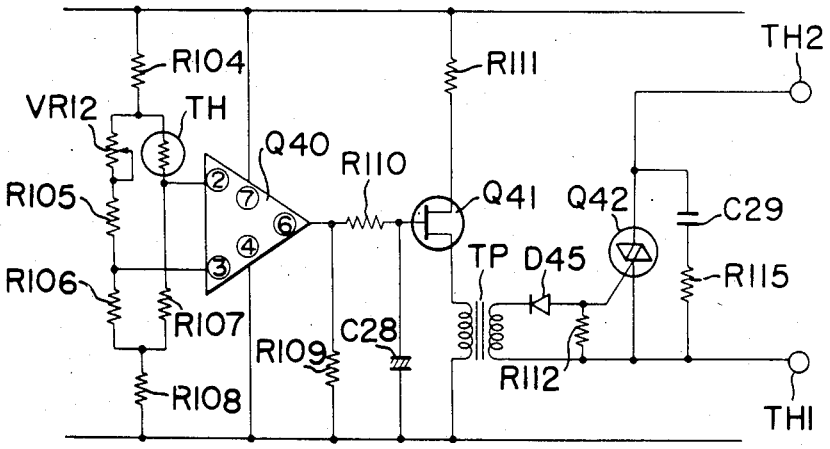
FIG. 10 is a temperature control circuit.

The electrical circuits will now be described. The electrical circuit comprises an AC 100 V power source system (FIG. 3), a timer circuit (FIG. 4), a central circuit (FIG. 5) for driving the original base for the book original, a control circuit (FIG. 6) for driving the sheet original, a jam detection circuit I and a circuit for detecting the presence of sheets within the cassette (FIG. 7), a jam detection circuit II (FIG. 8), a timing circuit (FIG. 9) for paper feed, and jam, a temperature control circuit (FIG. 10), and an arrangement view (FIG. 11) for micro-switches (on drum). FIG. 12 is a time chart for said micro-switches.

The copying machines shown in FIGS. 1 and 2 may be used with both sheet and book originals as described above by changing-over a part of the machine, but the case of the sheet original will be first described.

(1) Power supply (FIG. 1):

If the machine is in normal condition, when door switches $MSD_1$ and $MSD_2$ and main switch SW (104) (the numeral in () denotes a reference character contained in the above description of the machine, and the same applies hereinbelow.) are turned ON, power is applied into the machine to place an AC 100 V circuit and a DC (DC 24 V) circuit in an operative condition.

(2) AC circuit (FIG. 3) and Timer circuit (FIG. 4): Then, at the same time when the SW (104) is turned ON, heaters $H_1$ and $H_2$ in the fixing part 46 are activated to heat the hot plate 28 (MS6A and 6B are switches which activate when jam detected and remain closed during normal operation.). A stir motor (M 2) for the developing machine 42 and cooling fans FM1 and FM2 are activated. A condenser C16 is instantaneously charged up through a resistor R41, diode B15, and resistor R43 (the value of R41+R43 is small) and at the same time transistors Q17 and Q18 are forward biased through a resistor R45 so that Q17 and Q18 are turned ON and relay K6 is turned ON, contact $K6_1$ (FIG. 3) of which connects the high voltage circuit of stabilizer St2 to light a fluorescent lamp FL2.3(6).

(3) Timer circuit (FIG. 4, delay of 12 seconds): A condenser C13 is then charged up through variable resistors VR 6 and VR7 and resistor R35 (however, the time constant of the timer circuit comprising VR6, VR7, R35, and C13 is controlled by short-circuiting or opening the VR6 through a thermoswitch SM2). Namely, when N channel gate thyristor Q15 is turned ON after a lapse of the required time (preparation prior to copying), a charge of C13 is applied through the resistor R39 to the gates of SCR Q16 which is turned ON. At this time, Q17 and Q18 are ON in the condition described in para. (2) above so that transistor Q19 is OFF and forward biased by a pilot lamp FL1 of transistor Q20, resistors R49 and R50, the transistor Q20 is then turned ON and relay K7 is turned ON to close its contacts $K7_1$ and $K7_2$ (FIG. 3) to active main drive meter N1, thus rotating the drum 1. Simultaneously high voltage transformer HVT AC:DC is activated.

(4) Pre-idling (one rotation):

If the machine is left unused for a long time, the photosensitive body is restored from its fatigue, so that it is necessary to uniformly expose the surface of the photosensitive body to radiation prior to the initiation of the copying operation in order to place it in a usable fatigue condition.

Figure 11:
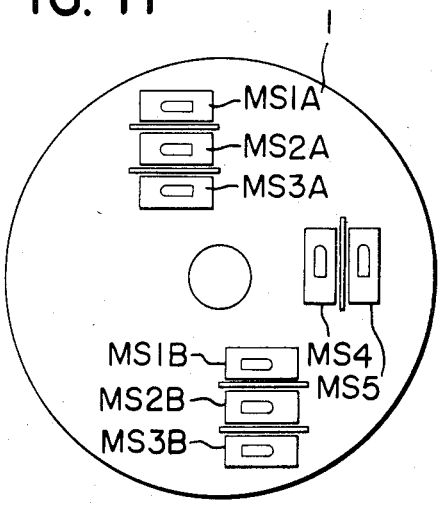
FIG. 11 shows an arrangement of a microswitch on the sensitive drum.
Figure 12:
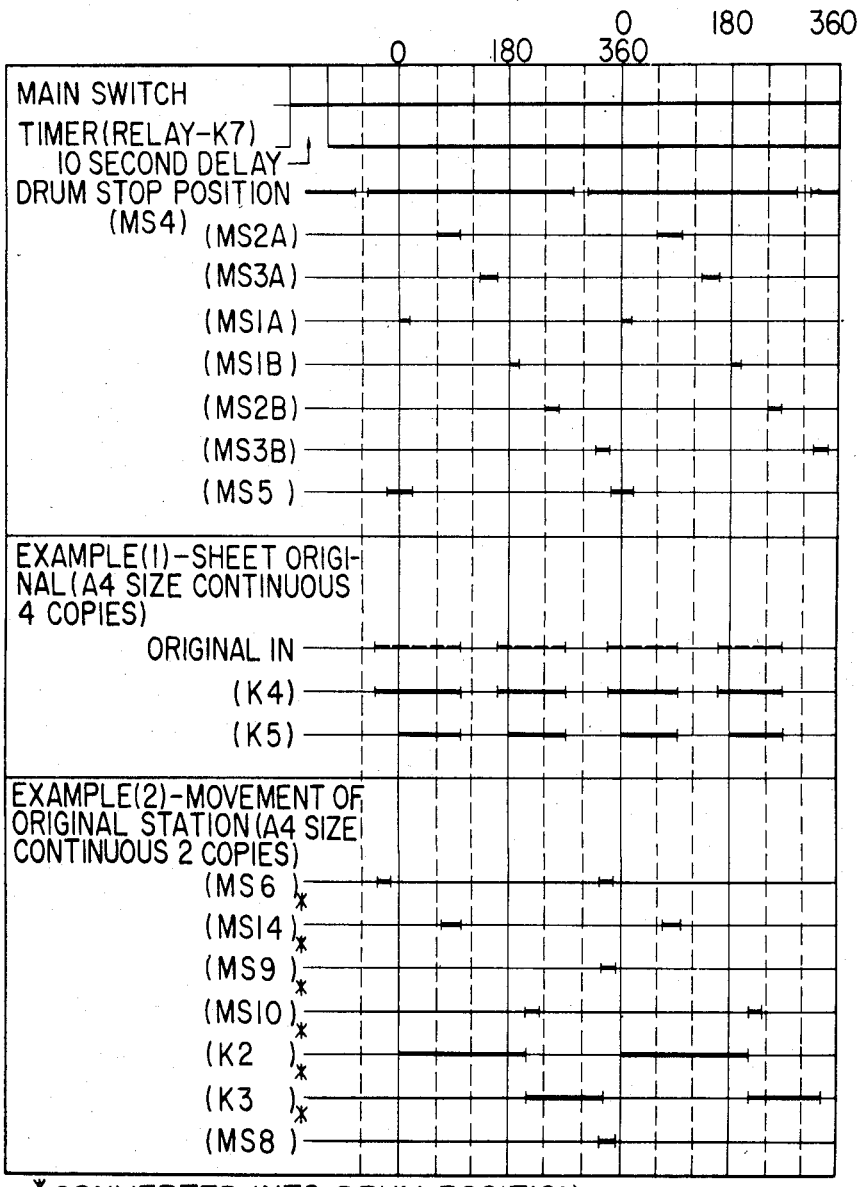
FIG. 12 is a time chart.

As shown in FIG. 11, the switching mechanism performs its timely function as given in the time chart in FIG. 12 by means of micro-switches arranged on the drum 1. Even if a sheet original is inserted at the same time when the drum 1 begins to rotate, the copying operation cannot be performed because the ground sides of micro-switches MS1A and MS1B (FIG. 6) are disconnected by SCR.Q22 (FIG. 4) so that relay K5 (FIG. 6) cannot be turned ON. When MS3A (FIG. 9) is activated, however, a signal is introduced into a gate of Q22 by diode D22 and resistor R56, and transistor Q20 is in ON and relay K7 is ON as mentioned above so that transistor Q21 is naturally turned ON by resistor R53 being self-energized by Q21 and resistor 54, and therefore MS1A and MS1B are grounded through the diode D21, thus permitting a normal copying operation from the second rotation of the drum.

(5) Copying operation:

Power is supplied, when solenoid SL3 (FIG. 6) is turned ON, to the original feed rollers $3_1$ and $3_2$ at the sheet original (hereinafter called an original) feed part 102, and when an original is inserted from the original guide 37, said original is transported leftwards as shown in FIG. 2. Then, when the extreme end of the original reaches the sheet original timing lamp L1 (5) light receiving element PD (38) (FIG. 6), through the transistor Q6 is forward biased by the variable resistor VR3 and resistor R8 prior to its arrival, PD (38) is directly exposed to light of L1(5) so that Q6 is reversely biased by an electromotive force of PD, turning Q7 ON.

Operation of the device is partly different between copying a sheet original and a thick original (book) as described previously, and therefore it requires switching of the machine. In this case, a connector ON which performs electrical switching is connected. In this instance, sheet originals are used so that the connector ON is connected and DC 24 V is applied. Simultaneously, when the remaining multipolar connectors connect L1 and light receiving element PD circuits, transistor Q6 is OFF, transistor Q7 is ON, and transistor Q8 is OFF, relay K4 not being operative. Then, the voltages of the coil of relay K4 and resistor R12 are produced with only impedance converted in the emitter of transistor Q9 so that voltage is applied to the gate of SCR Q10 to turn Q10 ON and to turn relay K8 ON by resistors R13 and the R14 and power source of solenoids SL2 and SL3 which control the original feed rollers is connected by the contact $K8_2$.

Figure 4:
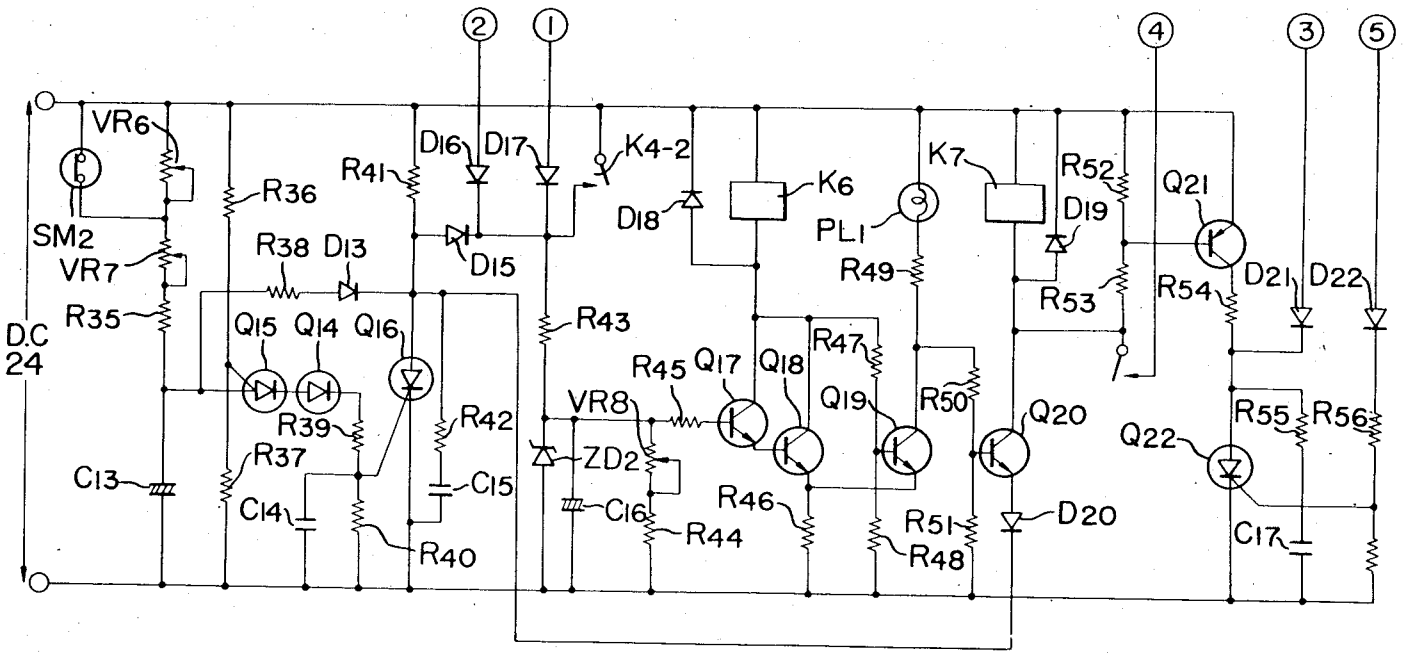
FIG. 4 is a timer circuit.

When the extreme end of the original reaches the L1 (5).PD (38), PD is not exposed to light radiation, so that the electromotive force of light receiving element PD becomes O, and transister Q6 is ON, transistor Q7 is OFF, transister Q8 and relay K4 are ON, selenoid SL3 is turned OFF by conact $K4_1$ of K4 and selenoid SL3 is turned ON by contact $K3_2$ and diode D9, and then the rollers $3_1$ and $3_2$ stop and the original also stops. Then, when the drum 1 is rotated to the position required, microswitch MS1A is turned ON and diode D21, SCR Q22 in FIG. 4 are connected from $K4_1$, K3 coil, contact $K9_2$, diode D3, and microswitch MS1A. When K3 is turned ON, solenoid SL2 is turned OFF and solenoid SL3 is turned ON by contact $K5_2$ to rotate the rollers $3_1$ and $3_2$, the original is transported leftwards in synchronization with the drum 1 and driven out to the upper part of the machine by the sheet original second rollers $4_1$ and $4_2$. During that time, the original passes on the upper portion of the original glass 40 at the illumination part 39 and is exposed to radiation from the bottom by the two illumination lamps FL2 and FL3 (6). The image is formed on the drum 1 at the exposure part 41 by means of reflection mirror 7 and in-mirror lens 8. A required electrostatic latent image is formed by high voltage transformers $HVT_{-AC}$ and $HVT_{-DC}$ and said optical system and enters the developing machine 42. Said latent image is then developed by the developing solution stirred by the stir motor.

(6) Paper feed (FIG. 9):

With respect to transfer paper 21 stored in the cassette 20, when the drum 1 is rotated and the microswitch MS2A is activated, a circuit comprising a $K5_3$, a diode D25, and MS2A (on) is completed so that the solenoid SL4 is activated to cause the normally rotating paper feed rollers 22 to move downwards which is then made in contact with the uppermost transfer paper, and one sheet of the transfer paper (hereinafter called paper) is transported as above described in the operation of machine.

However, microswitch MS2A in a circuit of MS2A, MS13, relay $KS_3$, and solenoid SL5 is turned OFF to stoup rotating timing rollers $23_1$ and $23_2$ controlled by SL5 so that the paper stops at $23_1$ and $23_2$. When NS2A is turned OFF and at the same time SL4 is turned OFF and SL5 is turned ON, thew paper is transported by the timing rollers. The paper 21 transferred and separated in a process as required is moved forward while being closely adhered to the hot plate 28 within the drying-and-fixing part 46 and driven onto the tray 32.

(7) Jam detection (FIGS. 8 and 9):

If papers are successively fed without noticing any jamming between the cassette and the tray 32, the separation belt 25 and other parts will be damaged and therefore the jamming should be detected. The basic principle of the jam detection circuit is as follows:

The relation between $t_s$ and $t_c$ is set to $t_s \geqq t_c$, where $t_s$ is the time at which the paper feed switch MS2A or NS2B (FIG. 9) activates for a second time after its first activation, and $t_c$ is the time during which the paper 21 moves the distance opposite to the timing rollers $23_1$ and $23_2$, separation roller 24, hot plate 28, drive-out first rollers $29_1$ and $29_2$, lamp $L_4$ of detection device, and light receiving element CdS3 (FIG. 4), and when said relation is $t_s \leqq t_c$, that is, when paper 231 is jammed on the way, the machine is caused to be stopped, thus locking to safety. As shown in FIG. 11, the drum, on which microswitches MS1B, 2B, and 3B (B group) are arranged in a symmetrical position displaced by 180° from a row of micro-switches MS1A, 2A, and 3A (A group), and MS4 and MS5 are arranged in a position displaced by 90° therefrom, is so designed as to copy, for its one rotation, one sheet in case of Size A3 and two sheets in case of Size A4. In case of Size A4, either A group of micro-switches or B group may be employed for copying.

Figure 8:
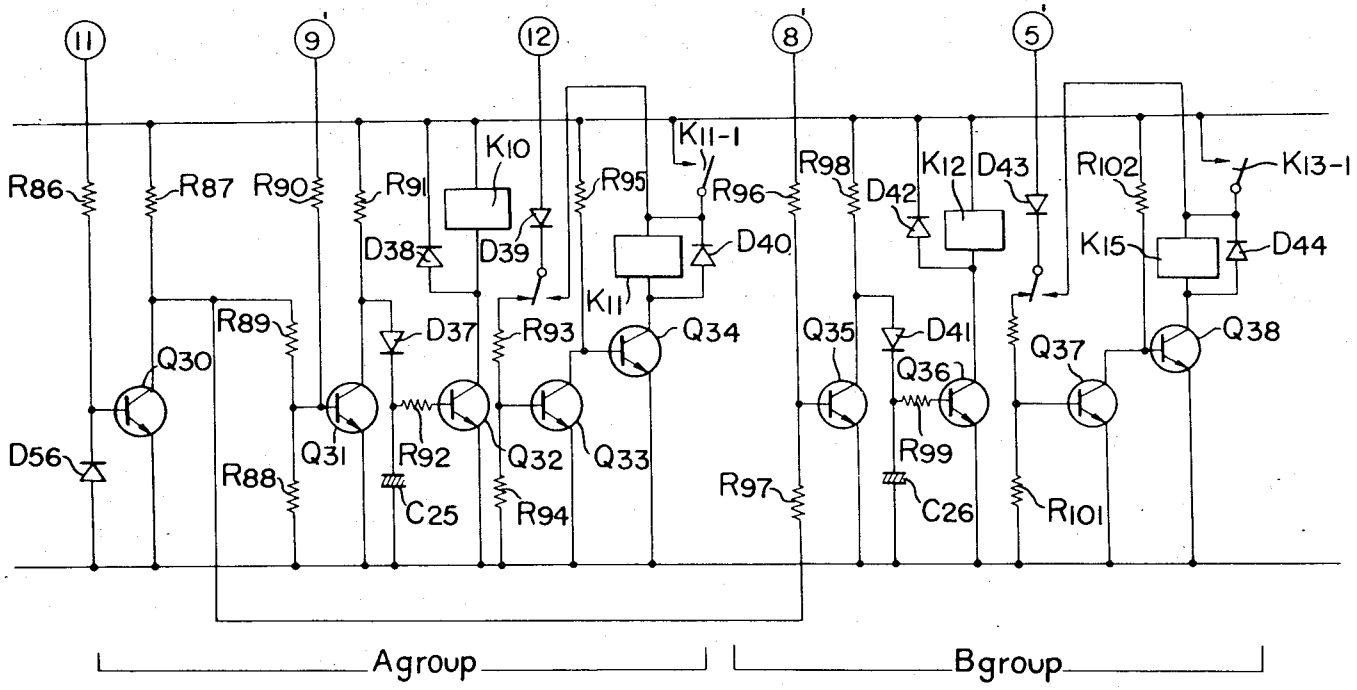
FIG. 8 is a jam detection circuit II.

When the original is inserted in the original feed rollers $3_1$ and $3_2$, operation is performed in a manner as described above to turn K4 ON and MS1A is activated to turn K5 ON. When micro-switch MS2A is then turned ON and solenoid SL4 ON, the transistor Q3Q is turned ON by the resistor R86 (FIG. 8) and the transistor Q31 is turned OFF by the resistors R87, 88, and 89. At this time, it is necessary to judge which switch has been activated, switches of A group or switches of B group. Therefore, this judgement is made by switch MS2A of A group and switch MS2B of B group and circuits corresponding to each group in FIG. 8 are used.

Since MS2A is in ON, transistor Q35 (FIG. 8) is forcibly turned ON by resistor R96 so that the circuit of B group is not activated. Since Q31 is OFF (MS2B—OFF), condenser C25 is instantaneously charged up by resistor R91 and diode D37, and resistor Q32 is turned ON said relay K10 ON by resistor 92, and even if MS2A is turned OFF, time being delayed by 0.5 seconds by C25 and R92 so that K10 is ON. Then, when MS3A (FIG. 9) is turned ON, K11 is turned ON by contact NO of K10, MS3A, and D39, being self-maintained by its own contact $K11_1$. Thereafter, transistor Q32 is turned OFF and K10 OFF. Alternatively, if switches of the B group are used, the circuit of B group functions in the quite the same way as the circuit of A group.

Figure 7:
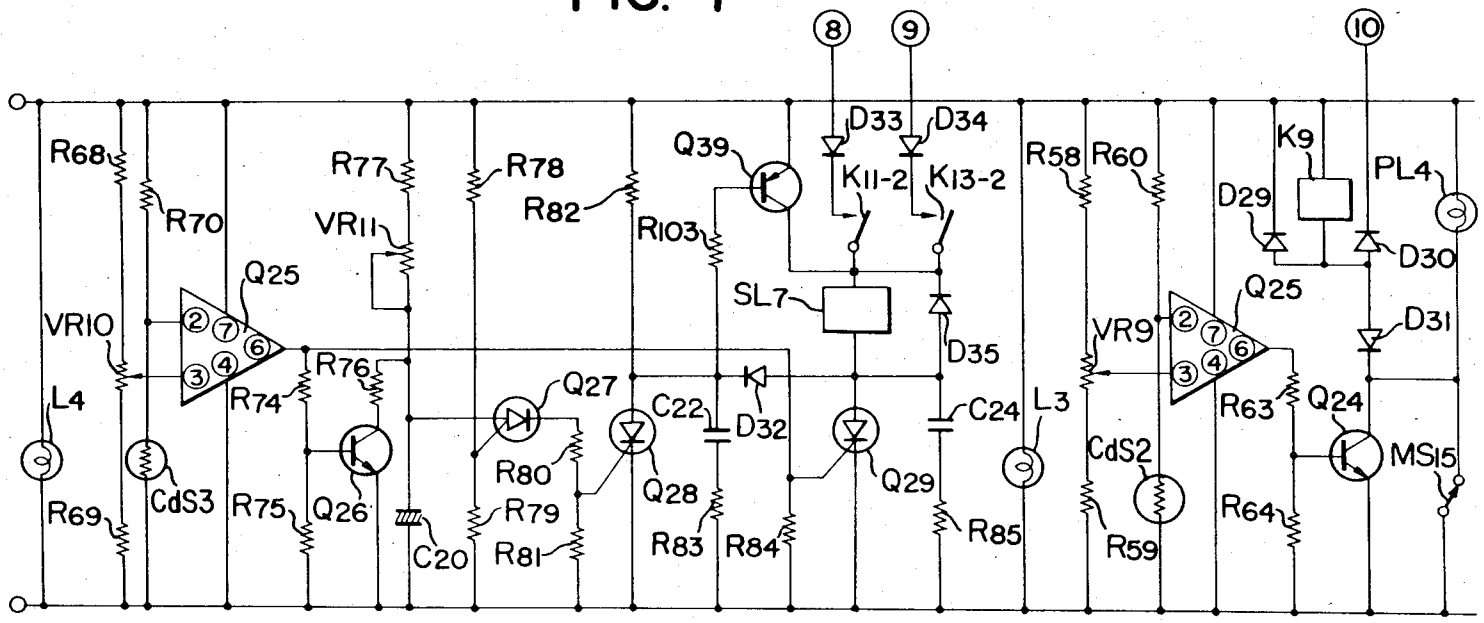
FIG. 7 shows a jam detection circuit I and a circuit which detects the presence of paper within a cassette.

The paper is started but has not reached the detection device which is a combination of a lamp L4 and a photoconductive element CdS3 as shown in FIG. 7, so that an amplification element Q25 is in ON and Q26 is in ON by resistors R74 and 75, and a timer circuit comprising a resistor R77, a variable resistor VR11 and condenser C20, a N channel gate thyristor Q27, a thyristor Q28, and a resistor R82 has its C20 short-circuited to turn Q27 and Q28 OFF. Thyristor 29 is about to be turned On with the arrival of the signal to its gate but will not be turned ON because $K13_2$ is closed and micro-switch MS2A is opened in connection of MS2A, D33 and $K11_2$. When MS2A is activated, that is, closed for the second rotation followed by the first rotation, a circuit of MS2A, D33, $K11_2$, and solenoid SL7 is completed. However, if the paper (transported by action of MS2A)

reaches the detection device as described above, Q25 is turned OFF and Q29 is also turned OFF, and SL7 is not operative.

When paper is jammed on the way, Q25 is turned ON and Q29 is turned ON, SL7 is naturally turned ON to activate microswitches MS6A and 6B (FIG. 3) actuated by SL7, and M1, $HVT_{AC}$, $HVT_{DC}$, $H_1$, and $H_2$ are turned OFF. As a result, the machine is stopped and at the same time a jam indicating lamp PL2 goes in. When the detection part is jammed to thereby intercept the light, Q25 and Q26 are in OFF so that after the lapse of a given time C20 is charged to turn Q27, Q28, and Q39 ON, and SL7 is activated to stop the machine as described above.

Figure 3:
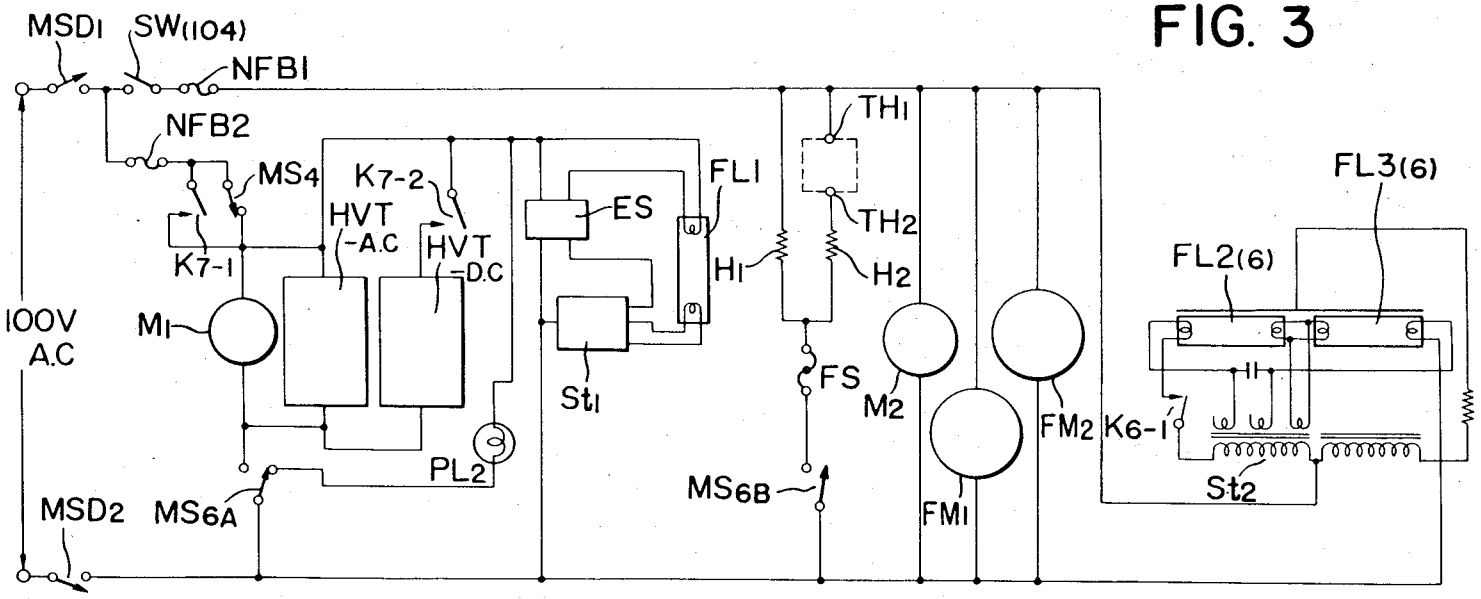
FIG. 3 is a circuit representation of a power source system.

(8) Means for making the surface potential of the photosensitive body substantially uniform during the time from the automatic stoppage (FIG. 4) and the termination of copying process to the stoppage of machine:

Since transistor Q16 stays ON in the preceding process, capacitor C16 is not charged by resistor R41 and diode D15. When the copying operation is effected, capacitor C16 is always charged through diodes D16 and D17 (in case of a thick original) or through $K4_2$ (in case of a sheet original), and K6 is maintained in its operative condition. On the contrary, when a copying operation is not effected, C16 is not charged so that transistors Q17 and Q18 are turned OFF and K6 is turned OFF by the time constant determined by capacitor C16, variable resistor VR8, resistors R44, and R45, and fluorescent lights FL2 and FL3 (6) are also turned OFF by contact $K6_1$ (FIG. 3).

Figure 6:
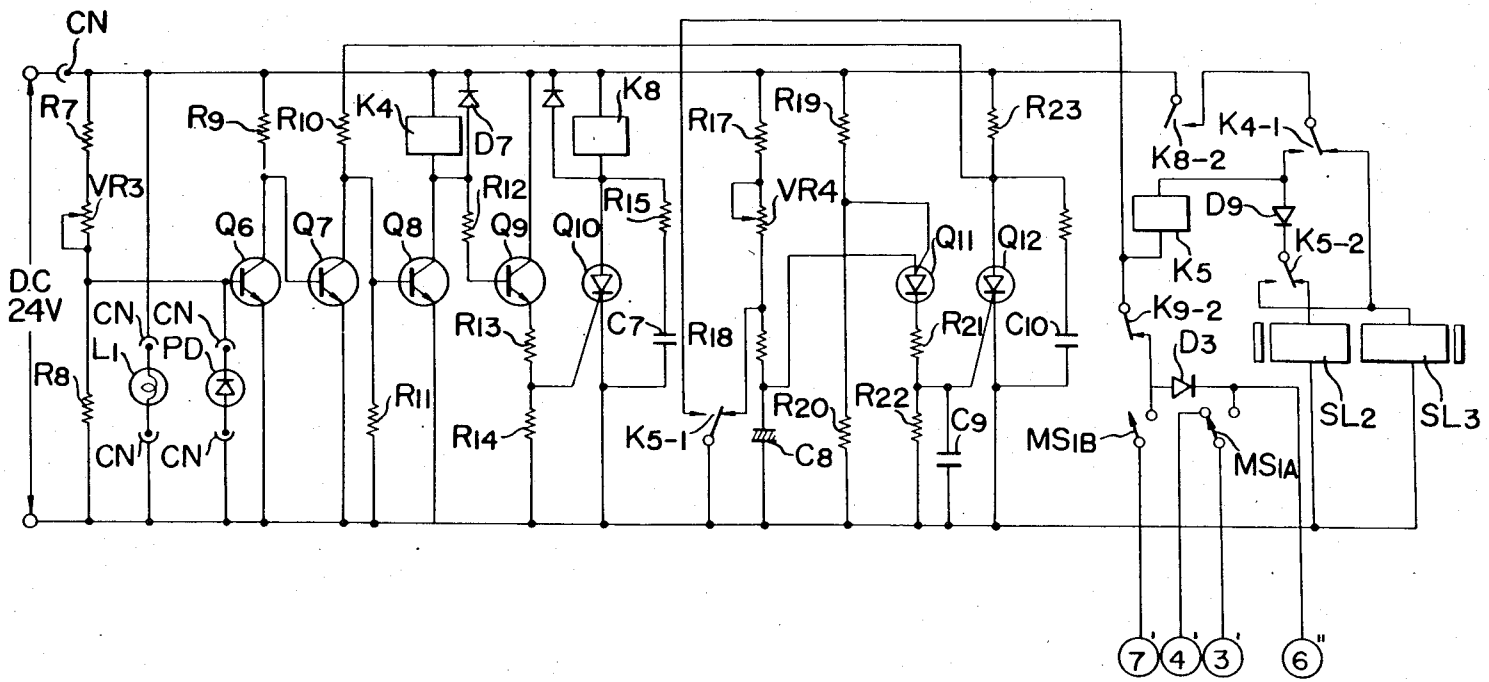
FIG. 6 is a diagram showing the electric circuit for driving and controlling a sheet original.

Further, transistor Q19 is turned ON, lamp PL1 goes on, and transistor Q20 is turned OFF, but contact K7 is maintained in its operative condition by activation of contact $K7_3$ and microswitch MS1A (FIG. 6).

Then, when MS1A is activated, contact K7 is turned OFF and $HVT_{DC}$ is turned OFF by contact $K7_2$ (FIG. 3), but M1, FL1, and HVAC are maintained in their operative conditions by a normally closed contact of micro-switch MS4 activated by the drum itself. After about one rotation (300° to 330°) followed by activation of MS1A (FIG. 9), only $HVT_{AC}$ (AC corona charger) and the whole surface exposure lamp FL1 (12) are activated during the time between the operation of MS4 and the stoppage of M1 to make the charge on the surface of the drum 1 uniform (sensitive body) and thereafter the rotation of the drum, that is, the machine is stopped. In this case, similar results may be obtained by peforming the exposure for only one rotation through only fluorescent lamp FL1, though its effect is inferior to that of the AC corona charger.

(9) Replenishment of paper (FIG. 7):

When paper 21 is present between the lamp L3 and the photoconductive element CdS2, the CdS2 is not exposed to light so that Q23 and Q24 are in OFF and relay K9 is also in OFF, which represents the normal condition and the pilot lamp PL4 will not light. When paper is not present, CdS2 is exposed to light so that Q23 and QW24 are in ON and K9 is in ON and PL4 is in ON, and a copying start circuit is disconnected by contact $K9_1$ of the K9 to initiate replenishing paper. Further, MS15 is turned OFF when the cassette 20 is properly set, thus representing the setting condition of the cassette.

(10) Temperature control (FIG. 10):

Variation of values in the resistor due to the temperature of the thermistor is detected and the temperature of the hot plate is controlled to a desired value.

Supposing that a control temperature is $T_o$ and a thermistor (TH) is then $R_o$, when the temperature of the hot plate is at $T_o$, the relation of variable resistoir VR12, fixed resistors R103, R106, and R107 in a bridge circuit is given by $(VR12\ (Q)+R105)\times R107=TH\times R106$, the potential difference between inputs 2 and 3 of amplifier Q40 becomes 0, the output terminal 6 is 0, the potential of emitter of uni-junction transistor Q41 is 0, and an oscillation circuit comprising a fixed resistor R110, a condenser C28, and Q41 is not oscillated so as not to produce output in a pulse transformer (TP), and accordingly a bi-directional thyristor Q42 is cut off and main heater H2 (FIG. 3) among heaters TH1 and TH2 is also turned OFF while only an auxiliary heater H1 is turned ON. However, the micro-switch MS6B is in a closed position and temperature fuse FS is properly connected.

Also, in the event the temperature of the hot plate is in excess of $T_o$, the output of Q40 becomes 0 similarly to the case as described above, the bi-directional thryistor Q42 is in OFF and H2 is also in OFF so that the hot plate is not heated, and therefore, the temperature stops to rise. Then, in the event the temperature of the hot plate becomes lower than $T_o$, the value of resistance of thermistor TH becomes larger than $R_o$ so that 2 of Q40 in output of said bridge circuit will have a potential lower than 3, and Q40 normally perform the amplifying operation. Accordingly, the output of Q40 is transmitted through the R110 and charged in capacitor C28, and when the charge exceeds the potential set by Q41 itself, the charge of C28 is rapidly discharged through TP. This pulse current is applied to the gate of Q42 through diode D45 and fixed resistor R112 to turn Q42 ON and to also turn H2 ON and the hot plate is heated rising its temperature. When reaching $T_o$, Q42 and H2 are turned OFF as monitored above, the same is repeated thereafter and a given temperature $T_o$ is maintained.

(11) Reciprecating movement of original base (FIG. 5):

Every part is normally operated in a manner as described above (in the case of the sheet original control circuit, connector ON in FIG. 6 is excluded), and K8 is turned OFF by the switching connector ON and contact $K8_1$ of K8 is turned ON (FIG. 5) to complete a relay K1 circuit. When copy button 107 (FIG. 1) is depressed, MS7 is turned ON and K1 is turned ON self-maintaining by its own contact $K1_1$. Then, when MS1A on the drum 1 is turned ON, relay K2 is placed in ON and clutch CL1 is activated by contact $K2_2$ to move the original base 2 leftwards in FIG. 2 in synchronisation with the peripheral speed of the drum 1, performing slit exposure Relay K2 also closes contact K2-3. SL4 and SL5 are turned ON and OFF on the way by means of micro-switch MS14 (FIG. 9) mounted on the moving passage of the original base 2 to feed paper in synchronisation with the original base 2. When the original base 2 reaches a position as required. MS 9 is activated (FIG. 5) in case of Size A3 and MS10 is activated in case of Size A4, and relay K3 is turned ON and K2 is turned OFF by contact $K3_2$ of said relay to activate clutch CL2, and at the same time the original base 2 is moved in a reverse direction and when the base reaches a position as required, MS8 is turned OFF, K3 is turned OFF, and CL2 is turned OFF, then the base stops. Since the turning OFF of relay K2 opens contact K2-3, operation of SL4 by accidental actuation of MS-14 is prevented. Operations other than the above are the same as that of the sheet original.

Another embodiment will now be described, in which an optical system having an in-mirror lens, a reflection lens and the like can be adjusted in order to solve the problem of unevenness and fog in an image.

One embodiment of a copying machine in which the invention is applied will be first described referring to FIGS. 1 and 2.

Optical adjustments generally performed are principally in adjustment of magnification between the original and its image and an adjustment of the focus. In case of an optical system using an in-mirror lens as in the copying mchine of the preferred embodiment, the former is accomplished by adjusting the ratio of light path length from the original surface to lens to light path length from the lens to exposure surface, while the latter is accomplished by adjusting the light path length by moving the in-mirror lens back and forth on its optical axis.

Although a case of copying with equal magnification will be described in the following for ease of explanation, the same holds for other magnifications.

In an optical system having a reflection mirror 7 and an in-mirror lens 8 as shown in this embodiment, the adjustment of magnification to equalize the light path lengths behind and in front of the lens for the light used in copying may be done in several ways. A first method thereof is to vertically move the original surface so as to equalize the distances. This method is simple and may be carried out by, for example, inserting a spacer under the glass 55 of the original surfce. This method however is not suitable for mass production because it is troublesoime in fine adjustment and in addition carefulness is required in handling the breakable glasses. Further, a second method is to adjust the light path length from the original to the lens by adjusting the reflection mirror 7. According to this method, it is easy to have a construction which permits fine adjustments, which method however is another one not suitable for mass production because the adjusting work should be done inside the machine and in addition a slight inclination of the mirror greatly influences the image so that it may require skill and time for a complete adjustment.

Figure 13:
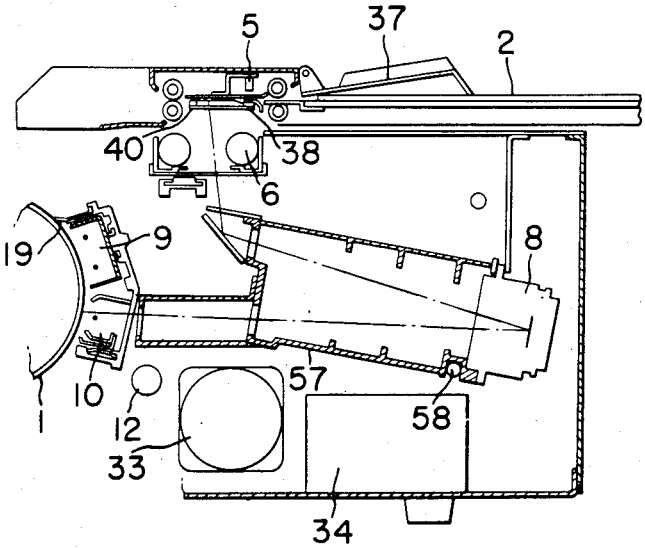
FIGS. 13 to 14 are front views lontigudinally sectioned of an optical system which embodies one form of the present method.
Figure 14:
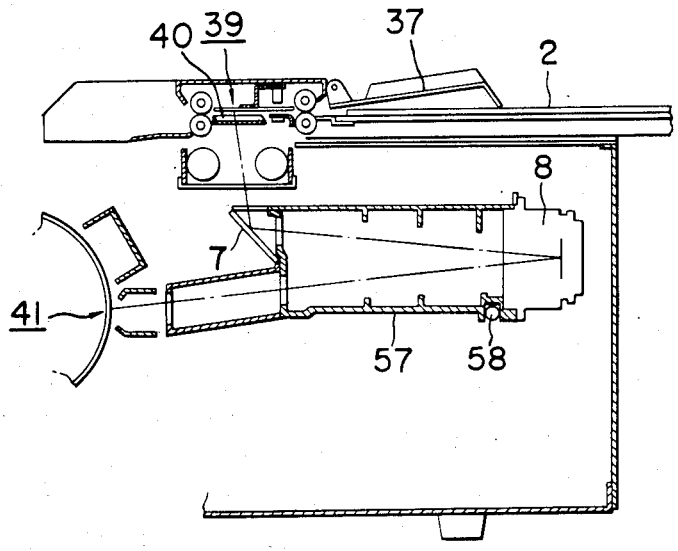

According to the preferred embodiment, the adjustment of magnification is carried out by rotating a case 57, which is provided with an in-mirror lens 8 and a reflection mirror 7 as shown in FIG. 13, on the shaft 58. This principle is describved referring to FIGS. 14 and 15. FIG. 14 illustrates an optical system slightly modified of the embodiment as described in the foregoing. The optical system, in which an optical axis of an in-mirror lens 8 is horizontally parallel with the original surface, is widely used in copying machines. There is not much difference between the conventional optical system and the optical system illustrated in FIG. 14 with the exception of their arrangement. Therefore, the description referring to FIG. 15 will be made in accordance with the embodiment of the optical system shown in FIG. 14.

Figure 15:
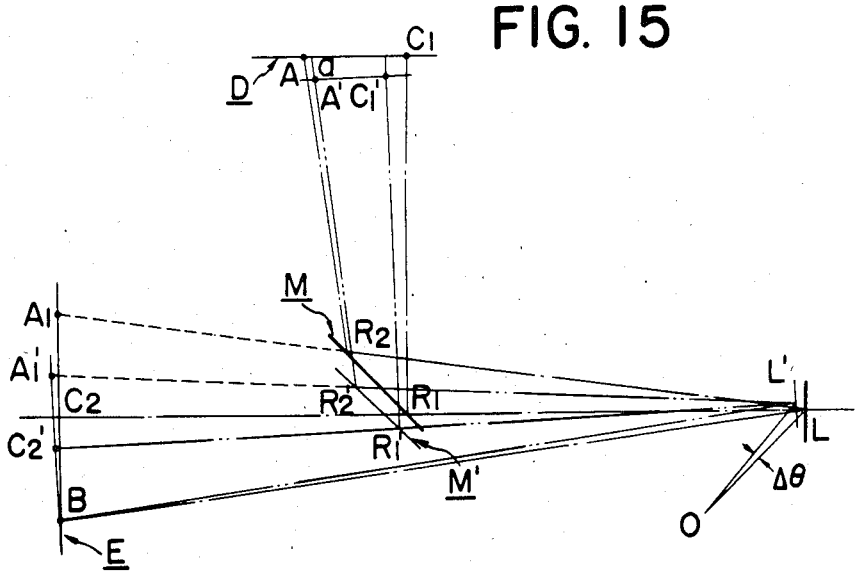
FIG. 15 is a view explaining the principle of the same.

In FIG. 15, there are shown an original surface D and an exposure surface E, and an exposure part B is determined. Reference N denotes a reflection mirror and L is a main plane for the in-mirror lens. It is supposed that the optical system is assembled as shown by the two-dot line. In this case, an image on the exposure part B is identical with the image of original positioned at g. As a result, the magnification of the image is given by $\overline{(BL')}/\overline{(aR_2'+R'_2L')}$, which is the ratio between the light path lengths of the incident and reflected light related to the lens. In general, the value of this ratio is not 1 with the accumulation of various errors. In FIG. 15, there is shown a point A', at which an image of equal magnification is obtained, that is, at which $\overline{(A'R_2'+R'_2L')}=\overline{(L'B)}$ is obtained. If the mirror M and in-mirror lens L are rotated at a suitable angle ΔO on the point O from the aforesaid state, a point A is obtained, in which a and A' are in line as indicated by the one dot line in FIG. 15. Namely, the image of original at A is formed in B and its magnification is $\overline{(AR_2+R_2L)}=\overline{LB}$, which corresponds to 1, completing the adjustment of magnification.

This method of adjustment has such advantages that adjustment can be done by a simple and accurate operation, that is, rotation on the fixed shaft 58. Such an adjustment does not require skilled operators, and further such an operation may be done in a short time.

Furthermore, it is preferable to select a position of a center O of rotation to be placed where the light path length BL does not vary much, i.e., on the light path, the optical axis of the lens, or a place in the vicinity of an extension thereof, in a sense of having little influence on the adjustment of focus which occurs after said adjustment of magnifiction, or to select places apart from the reflection mirror M in order to reduce variation aA of the position A of the original.

FIGS. 1 and 2 illustrate a copying machine in which a method for adjusting optical system according to the invention is applied.

This copying machine is a liquid development transfer type which has a construction designed principally for sheet-like originals such as documents and is also designed to easily take copies of thick originals such as books or the like.

Another embodiment will now be described, which embodiment has for its object to provide an even image over the whole slit by adjusting the exposure in the aforesaid optical system in order to solve the problem of unevenness of the image.

Figure 16:
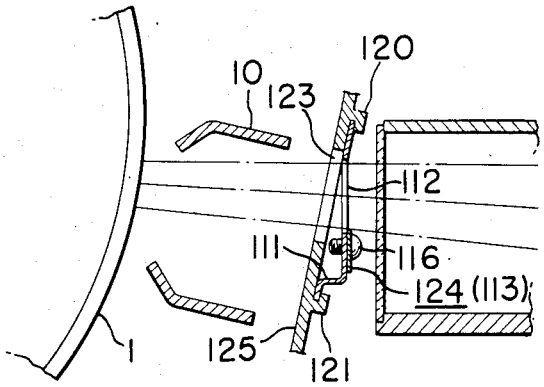
FIG. 16 is an enlarged part of the exposure part of the above.

A transfer type electrophotographic copying machine as shown in FIG. 1 is of a type in which an original O is transported by means of feed rollers $3_1$, $3_2$, $4_1$, and $4_2$ and the original O is exposed to light radiation from the bottom of an original glass 40 by two illumination lamps 6 and 6, and the light reflected therefrom is received by a mirror 7 and an in-mirror lens 8 to form an original image on the photosensitive drum 1, and at that time the quantity of light at the exposure part 41 is to be determined by a slit 112 of a slit plate 111 (shown in FIG. 16) arranged in the vicinity of the exposure part.

In such an exposure system, however, fluoroescent lamps, halogen lamps or the like are generally used as illumination lamps 6 and 6 so that both ends of the lamp are weaker in brightness than the central portion and both side portions of the original are exposed to light weaker than the central portion. Further, the quantity of light in the periphery thereof is less than that of the central portion due to the nature of lens. As a result, there is projected an image on the drum 1, which corresponds to both end portions of the slit 112, darker than that corresponding to the central portion of the slit 112 under these influences, thereby making it impossible to obtain an entirely uniform image.

This invention has as its object to eliminate those problems noted above, wherein a control plate 124 is mounted on said slit plate 111, said control plate 124 being reciprocated in the width direction of the slit 112, said reciprocation causing the ratio of width between the central portion of the slit 112 and both side portions to vary.

Figure 17:
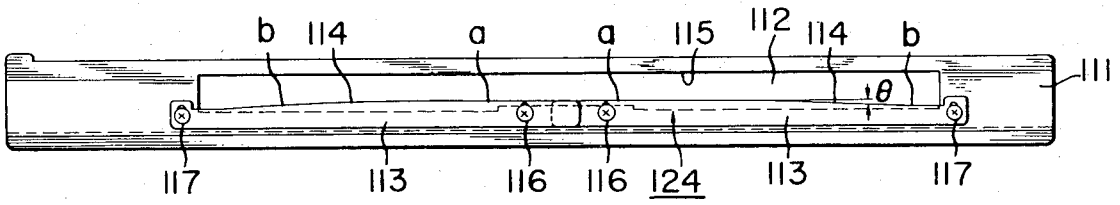
FIG. 17 is a plan view of a slit plate of the above.
Figure 18:
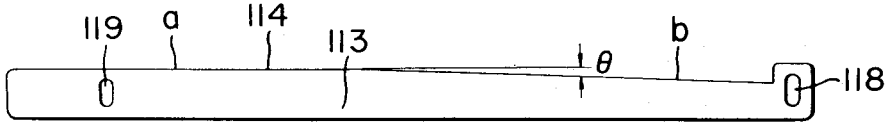
FIG. 18 is a plan view of said control plate.

In the embodiment shown, the control plate 124 comprises two short plates 113 and 113 of the same shape as shown in FIGS. 17 and 18. The length of said short plate 113 is about one half of the total length of the slit 112, and about one third ($\frac{1}{3}$) of side 114 opposite to the slit 112 is made a straight line in approximate parallel with the long side 115 of the slit 112 and the remaining about two third ($\frac{2}{3}$) thereof is gradually tapered towards the outside at an angle of inclination O. In order to form a control plate 124, according to the invention, two short plates 113 and 113 are oppositely located with linear portions a and a slightly overlapped and mounted on the slit plate 111 retractably with respect to the width direction of the slit by means of screws 116 and 117, and slots 118 and 119. In the case as shown, the slit plate 111 is then detchably fitted between guides 120 and 121 provided on the support frame 125 of a charger 10. Reference character 123 denotes a window pervious to light made in the support frame 125. The ratio of linear portion a of said central plate 124 to inclined portion b is a value obained by experiment of the angle of inclination O. Further, the aforesaid control plate 124 may also comprise one long plate.

Since the invention has the construction as described above, in the event both ends of the illumination lamps 6 and 6 are turned black to reduce its brightness as compared with the central portion, the exposure over the whole area of the slit 112 can be made uniformal by untightening mounting screws 116 and 117 on the control plate 124 to move forward said control plate 124 so that the ratio of width of the central portion in the slit 112 to that of the both side portions may be varied.

Furthermore, novel improvements in the electrophotographic device according to the invention will be introduced in the followinig:

This improvement is concerned with a paper rejection tray for the copying machine, and has as its object to provide a paper rejection tray which can respond to copying paper such as transfer paper, photosensitive paper and the like of various sizes.

One embodiment of copying machine in which this invention is applied will be described. The paper rejection tray may be divided broadly into two types. One has a downwardly inclined plane from a paper rejection part, while the other has an upwardly inclined plane from the paper rejection port.

It is possible for the former falling type tray to easily accumulate copying paper as long as there is a head to some extent or more, but in the case where the paper rejection port is positioned at the lower part of the machine body or the cassette is arranged at the lower part of the paper rejection port as shown in the copying machine of the foregoing embodiment so that a sufficient head may not be provided, the copying paper cannot be completely dropped and the rear end of the paper is caught in the paper rejection port to thus cause successive copying papers to be jammed. As for the latter rising type tray, there is no need of apprehension about a head as in the said falling type, but in the case where the copying paper of large size is very flexible, thus increasing the friction resistance between the paper and the inclined plane of the tray, the extreme end of the copying paper tends to cease moving on the way to the tray to cause successive copying paper to be jammed as in the aforesaid falling type tray. Both types as above-described have such disadvantages that a tray occupies a good deal of space for the largest size copying paper and gets in the way when the cassette is replaced, which are not favorable in view of function and operation.

This invention has the its object to eliminate the aforesaid disadvantages, and provides a paper rejection tray comprising a main tray 32 disposed in an upwardly inclined plane with respect to the moving direction of the copying paper to be rejected and an auxiliary tray $32_1$ disposed in a downwardly inclined plane arranged at the extreme end thereof.

Therefore, where copying paper $P_1$ of small size is used, the copying paper $P_1$ sent out of the paper rejection port 54 moves on the upward inclined plane of the main tray 32, and when the rear end of the paper comes out of the paper rejection port 54, it is accumulated on the main tray 32. In this case, as long as the copying paper $P_1$ has firmness similar to that of conventional paper, it never bends. When a copying paper $P_2$ of large size is used, the extreme (i.e., leading edge) end of the copying paper $P_2$ is bent downwards by its own weight from the upper end of the inclined plane of main tray 32, moves downwards along the inclined plane of auxiliary tray $32_1$, and R accumulated in the form of mountain-shape on the main tray 32 and the auxiliary tray $32_1$ (see FIG. 19). In this case, it is preferable to use a cover $C_1$ for opening and closing the cassette C as a part of the tray and to use a handle $C_2$ thereof as a stopper of the copying paper $P_2$.

Figure 19:
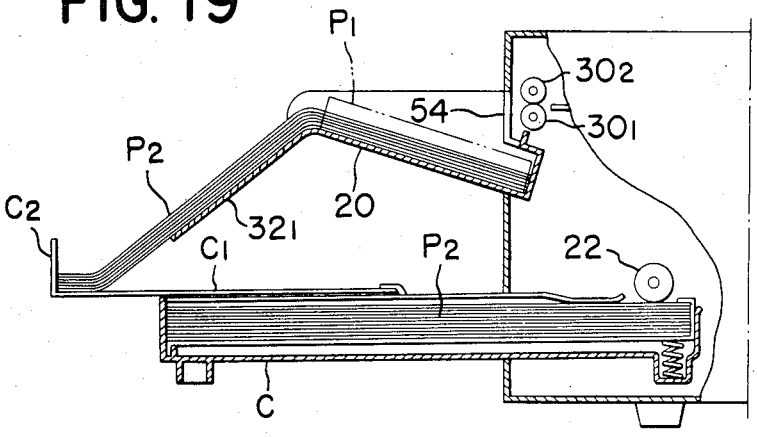
FIG. 19 is a sectional view showing one form of a paper ejection tray according to this invention.

With the construction as described above of the invention, even if a large head cannot be provided, for the cassette is positioned at the lower part of the paper rejection port, copying paper of small size as well as large size can accurately be accumulated by properly combining the upwardly inclined plane and the downwardly inclined plane, and the cassette can easily be removed. Further, it is possible to use the cassette cover as a part of the tray and it is possible to provide a compact construction by encasing a tray within the length of cassette as shown in FIG. 19.

Figure 20:
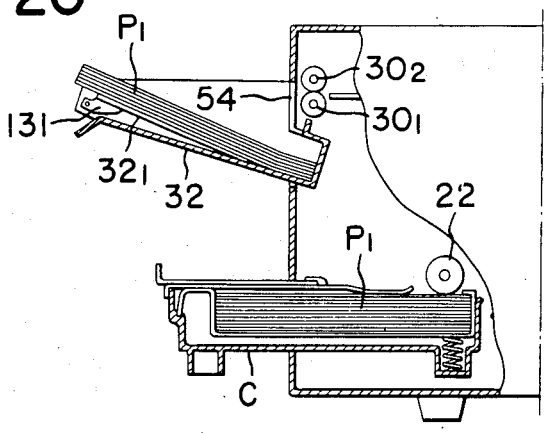
FIG. 20 is a sectional view showing another embodiment.

Furthermore, the main tray 32 and the auxiliary tray $32_1$ may be integrally formed, but as shown in FIG. 20 both trays 32 and $32_1$ can be constructed to be opened or closed with a hinge so that when the auxiliary tray $32_1$ is used for copying paper of small size, it may be lapped over the main tray 32, and when the tray $32_1$ is used for copying paper of large size, it may be left open for use, thus providing a tray which functions effectively.

We claim:

1. A copying apparatus comprising:

means for transporting a copy material along a transport path;

means, located in said path, for detecting the presence of the copy material;

means for presetting a first copy mode or a second copy mode;

means for producing timing signals at regular intervals during a multiple copying operation:

jam detecting means, responsive to said detecting means and said timing signal producing means, for detecting a jammed copy material by discriminating the presence of the copy material at said detecting means in response to the timing signals, produced at a first interval, in the first copy mode and in response to the timing signals, produced at a second interval in the second copy mode different from the first interval and for producing an output signal in response to the said jam detection.

2. An apparatus according to claim 1, wherein said copy modes relate to original scanning methods.

3. An image forming apparatus comprising:

a rotatable medium;

means for forming an image on said rotatable medium and transferring the image onto a transfer material;

means for transporting the transfer material along a transport path;

means, located in said path, for detecting the presence of the transfer material;

means for presetting a first size mode or a second size mode;

means for producing timing signals, on the basis of the rotation of said rotatable medium, at a regular interval;

jam detecting means, responsive to said detecting means and said timing signal producing means, for detecting a jammed material by discriminating the presence of the transfer material at said detecting means in response to the timing signals produced at the first regular interval, in the first size mode and in response to the timing signals, produced at the second regular interval, in the second size mode and for producing an output signal in response to the jam detection.

4. An image forming apparatus comprising:

means for transporting a sheet material along a transport path;

means, located in said path, for detecting the presence of the material;

means for presetting a first size mode or a second size mode;

means for producing timing signals at an interval during a repetition of image formations;

jam detecting means, responsive to said detecting means and said timing signal producing means, for detecting a jammed material by discriminating the presence of the material at said detecting means in response to the timing signals, produced at a first interval, in the first size mode and in response to the timing signals, produced at a second interval in the second size mode different from the first interval and for producing an output signal in response to the jam detection.

* * * * *

UNITED STATES PATENT AND TRADEMARK OFFICE

CERTIFICATE OF CORRECTION

PATENT NO. : 4,662,740

DATED : May 5, 1987

INVENTOR(S) : SHIGEHIRO KOMORI, ET AL.

It is certified that error appears in the above-identified patent and that said Letters Patent is hereby corrected as shown below:

COLUMN 1

Line 29, "photosensitve" should read --photosensitive--.
Line 43, "system a," should read -- system, a--.
Lines 45-46, "are disposed" should be deleted.
Line 47, "To" should read --In--.
Line 59, "produce" should read --produces--.

COLUMN 2

Between Lines 4 and 5, "SUMMARY OF THE INVENTION" should be inserted.
Line 59, "particular" should read --practical--.

COLUMN 3

Line 19, "at" should be deleted.
Line 24, "a transfer" should read --transfer--.
Line 41, "sation" should read --zation--.
Line 50, "synchronisation" should read --synchronization--.

COLUMN 5

Line 18, "pulley" should read --pulleys--.
Line 32, "not shown" should read --(not shown)--.
Line 46, "book" should read --a book--.

COLUMN 6

Lines 12-13, "number of is produced copies." should read --number of copies is produced.--.
Line 46, "transferred" should read --transfer--.

UNITED STATES PATENT AND TRADEMARK OFFICE

CERTIFICATE OF CORRECTION

PATENT NO. : 4,662,740

DATED : May 5, 1987

INVENTOR(S) : SHIGEHIRO KOMORI, ET AL.

It is certified that error appears in the above-identified patent and that said Letters Patent is hereby corrected as shown below:

COLUMN 6

Line 49, "as it is" should read --as is in--.
Line 63 "least by" should read --least a--.

COLUMN 7

Line 1, "are cleaners 17 and 18 and" should read --and cleaners 17 and 18 are--.
Line 24, "denergized" should read --deenergized--.
Line 26, "different." should read --differently.--.
Line 44, "central" should read --control--.

COLUMN 8

Line 2, "when jam detected" should read --when a jam is detected--.
Line 15, "VR 6" should read --VR6--.
Line 25, "pilot lamp FL1" should read --pilot lamp PL1--.
Line 28, "active" should read --activate--.
Line 29, "meter" should read --motor--.

COLUMN 9

Line 16, "and the R14 and" should read --and R14 and the--.
Line 22, "transister" should read --transistor--.
Line 23, "transister" should read --transistor--.
Line 23, "selenoid" should read --solenoid--.
Line 24, "conact" should read --contact--.
Line 24, "selenoid SL3" should read --solenoid SL2--.
Line 25, "$K3_2$" should read --$K5_2$--.
Line 29, "K3 coil" should read --K5 coil--.
Line 30, "When K3" should read --When K5--.

UNITED STATES PATENT AND TRADEMARK OFFICE

CERTIFICATE OF CORRECTION

PATENT NO. : 4,662,740

DATED : May 5, 1987

INVENTOR(S) : SHIGEHIRO KOMORI, ET AL.

It is certified that error appears in the above-identified patent and that said Letters Patent is hereby corrected as shown below:

COLUMN 9

Line 60, "stoup" should read --stop--.
Line 61, "NS2A" should read MS2A--.
Line 63, "thew" should read --the--.

COLUMN 10

Line 8, "NS2B" should read --MS2B--.
Line 14, "paper 231" should read --paper 21--.
Line 16, "locking" should read --looking--.
Line 30, "Q3Q" should read --Q30--.
Line 42, "resistor" should read --transistor--. (2nd occurrence)
Line 43, "said" should read --and--.
Line 43, "resistor 92" should read --resistor R92--.
Line 61, "29" should read --Q29--.
Line 62, "On" should read --ON--.

COLUMN 11

Line 9, "in" should read --on--.
Line 12, "Q39" should read --Q29--.
Line 40, "HVAC" should read --$HVT_{AC}$--.
Line 51, "peforming" should read --performing--.
Line 61, "QW24" should read --Q24--.

COLUMN 12

Line 6, "resistoir" should read --resistor--.
Line 7, "R103" should read ---R105--.
Line 8, "(VR12(Q)" should read --(R12(Ω)--.

UNITED STATES PATENT AND TRADEMARK OFFICE

CERTIFICATE OF CORRECTION

PATENT NO. : 4,662,740

DATED : May 5, 1987

INVENTOR(S) : SHIGEHIRO KOMORI, ET AL.

It is certified that error appears in the above-identified patent and that said Letters Patent is hereby corrected as shown below:

COLUMN 12

Line 36, "rising" should read --raising--.
Line 38, "monitored" should read --mentioned--.
Line 40, "Reciprecating" should read --Reciprocating--.
Line 53, "chronisation" should read --chronization--.
Line 54, "exposure Relay" should read --Exposure. Relay--.
Line 58, "sychronisation" should read --synchronization--.
Line 59, "required." should read --required,--.

COLUMN 13

Line 14, "mchine" should read --machine--.
Line 32, "surfce." should read --surface--.
Line 34, "blesoime" should read --blesome--.
Line 49, "describved" should read --described--.
Line 63, "N" should read --M--.
Line 67, "g." should read --a.--.

COLUMN 14

Line 26, "magnifiction" should read --magnification--.
Line 53, "fluoroescent" should read --fluorescent--.

COLUMN 15

Line 13, "O." should read --θ.--.
Line 20, "detchably" should read --detachably--.
Line 24, "central" should read --control--.
Line 26, "O." should read --θ.--.
Line 39, "followinig:" should read --following:--.
Line 45, "of" should read --of the--.
Line 49, "part," should read --port,--.

UNITED STATES PATENT AND TRADEMARK OFFICE

CERTIFICATE OF CORRECTION

PATENT NO. : 4,662,740

DATED : May 5, 1987

INVENTOR(S) : SHIGEHIRO KOMORI, ET AL.

It is certified that error appears in the above-identified patent and that said Letters Patent is hereby corrected as shown below:

COLUMN 16

Line 6, "has the its" should read --has as its--.
Line 25, "R" should read --is--.

Signed and Sealed this

Ninth Day of February, 1988

*Attest:*

DONALD J. QUIGG

*Attesting Officer*

*Commissioner of Patents and Trademarks*